US010029826B2

(12) United States Patent
Petkovsek

(10) Patent No.: US 10,029,826 B2
(45) Date of Patent: Jul. 24, 2018

(54) FALSE FLANGE CHILD RESISTANT CLOSURE FOR RECLOSEABLE POUCH AND METHODS

(71) Applicant: Reynolds Presto Products Inc., Lake Forest, IL (US)

(72) Inventor: Gregory L. Petkovsek, Waupaca, WI (US)

(73) Assignee: Reynolds Presto Products Inc., Lake Forest, IL (US)

( * ) Notice: Subject to any disclaimer, the term of this patent is extended or adjusted under 35 U.S.C. 154(b) by 0 days.

(21) Appl. No.: 14/208,261

(22) Filed: Mar. 13, 2014

(65) Prior Publication Data

US 2014/0270586 A1 Sep. 18, 2014

Related U.S. Application Data

(63) Continuation of application No. 61/791,179, filed on Mar. 15, 2013.

(51) Int. Cl.
*B65D 33/16* (2006.01)
*B65D 33/25* (2006.01)

(52) U.S. Cl.
CPC ..... *B65D 33/2508* (2013.01); *B65D 2215/08* (2013.01)

(58) Field of Classification Search
CPC ..... B65D 33/2508; B65D 33/2516; B65D 33/255; B65D 33/34; B65D 33/24
USPC ..... 383/63, 65, 61.2, 59
See application file for complete search history.

(56) References Cited

U.S. PATENT DOCUMENTS

| | | | | |
|---|---|---|---|---|
| 4,736,451 | A * | 4/1988 | Ausnit | 383/65 |
| 5,564,834 | A * | 10/1996 | Porchia et al. | 383/211 |
| 5,672,009 | A * | 9/1997 | Malin | 383/204 |
| 5,711,609 | A | 1/1998 | Simonsen | |
| 7,674,039 | B2 * | 3/2010 | McMahon et al. | 383/61.2 |
| 8,192,085 | B2 * | 6/2012 | Pawloski et al. | 383/65 |
| 8,550,716 | B2 * | 10/2013 | Smith et al. | 383/63 |
| 2003/0138171 | A1 | 7/2003 | Kikuchi | |
| 2003/0167607 | A1 * | 9/2003 | Linton | 24/585.12 |
| 2003/0215163 | A1 * | 11/2003 | Schneider | B65D 33/2525 383/61.2 |
| 2004/0078939 | A1 * | 4/2004 | Pawloski | 24/400 |
| 2005/0196076 | A1 * | 9/2005 | Tanaka et al. | 383/63 |
| 2005/0286812 | A1 * | 12/2005 | Sprague et al. | 383/61.2 |
| 2006/0008186 | A1 | 1/2006 | Kusz | |
| 2006/0104550 | A1 * | 5/2006 | Kuge | B65D 31/10 383/206 |
| 2008/0232722 | A1 * | 9/2008 | Pawloski et al. | 383/64 |
| 2011/0103717 | A1 * | 5/2011 | Kasai | 383/64 |

* cited by examiner

*Primary Examiner* — Derek Battisti
(74) *Attorney, Agent, or Firm* — Merchant & Gould P.C.

(57) ABSTRACT

A reclosable zipper pouch includes a flange in covering relation to a portion of a first wall panel extending between a first zipper profile member and a mouth, when viewed from the open mouth, to provide difficulty to a child to open the pouch, and remain easy for an adult or senior citizen to open the pouch.

18 Claims, 2 Drawing Sheets

FALSE FLANGE CHILD RESISTANT CLOSURE FOR RECLOSEABLE POUCH AND METHODS

CROSS REFERENCE TO RELATED APPLICATIONS

This application claims the benefit of provisional application Ser. No. 61/791,179, filed Mar. 15, 2013, which is incorporated herein by reference in its entirety.

TECHNICAL FIELD

This disclosure relates to reclosable zipper pouch. More particularly, this disclosure relates to a reclosable zipper pouch that is child resistant.

BACKGROUND

A reclosable pouch having a press to close zipper closure is easy to open for children and adults. If the pouch is intended to have contents that are potentially harmful, there is a need to provide a closure and method to increase the difficulty for children to open the pouch and yet still be easy to open for adults and senior citizens.

SUMMARY

In one aspect, a reclosable zipper pouch includes a surrounding wall having a closed bottom, first and second opposite sides, an open mouth, and first and second opposing wall panels between the first and second opposite sides. The surrounding wall defines an interior volume therein. The pouch includes a reclosable zipper closure adjacent to the mouth. The zipper closure provides selective access to the interior volume through the mouth. The zipper closure includes a first zipper profile member on the first wall panel and extending toward the second wall panel. The zipper closure includes a second zipper profile member on the second wall panel and extending toward the first wall panel and in a location to engage the first profile member. The first and second profile members are constructed and arranged to selectively interlock when pressed together and unlock when forced apart. A flange extends from the second wall panel toward the first wall panel and is in covering relation to a portion of the first wall panel extending between the first zipper profile member and the mouth.

In example aspects, the flange has a fixed end at the second wall panel and a free end. The free end is adjacent to the mouth and is at least adjacent to the first wall panel.

In example aspects, the free end of the flange is releasably secured to the first wall panel. This releasable security can be through a pressure sensitive adhesive, or with a hook and loop fastener, for example.

In another aspect, a method of making a reclosable zipper pouch is provided. The method includes providing a surrounding wall having a closed bottom, first and second opposite sides, an open mouth, and first and second opposing wall panels between the first and second opposite sides. The surrounding wall defines an interior volume therein. There is a step of providing a reclosable zipper closure adjacent to the mouth. The zipper closure provides selective access to the interior volume through the mouth. The zipper closure includes a first zipper profile member on the first wall panel and extending toward the second wall panel. The zipper closure includes a second zipper profile member on the second wall panel and extending toward the first wall panel and in a location to engage the first profile member. The first and second profile members are constructed and arranged to selectively interlock when pressed together and unlock when forced apart. The method includes providing a flange extending from the second wall panel toward the first wall panel and in covering relation to a portion of the first wall panel extending between the first zipper profile member and the mouth.

A variety of examples of desirable product features or methods are set forth in part in the description that follows, and in part will be apparent from the description, or may be learned by practicing various aspects of this disclosure. The aspects of the disclosure may relate to individual features as well as combinations of features. It is to be understood that both the foregoing general description and the following detailed description are explanatory only, and are not restrictive of the claimed invention.

DETAILED DESCRIPTION

Figure 1:
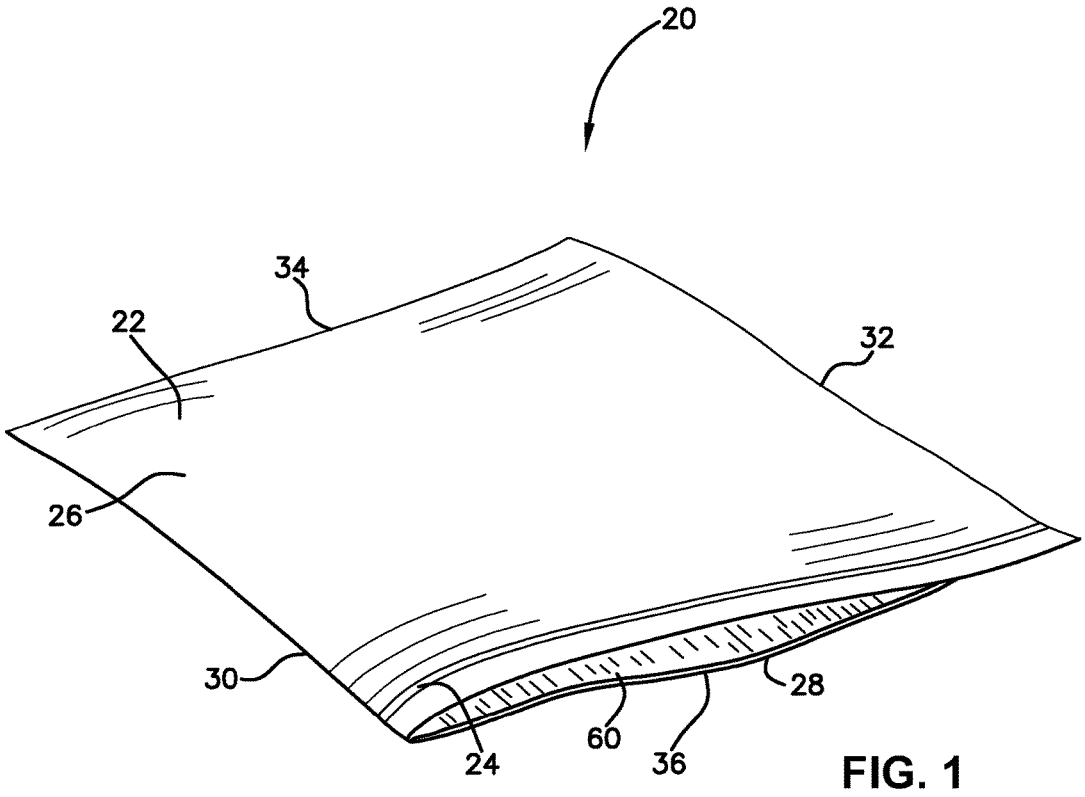
FIG. 1 is a schematic, perspective view of a reclosable pouch incorporating the zipper closure, constructed in accordance with principles of this disclosure.
Figure 2:
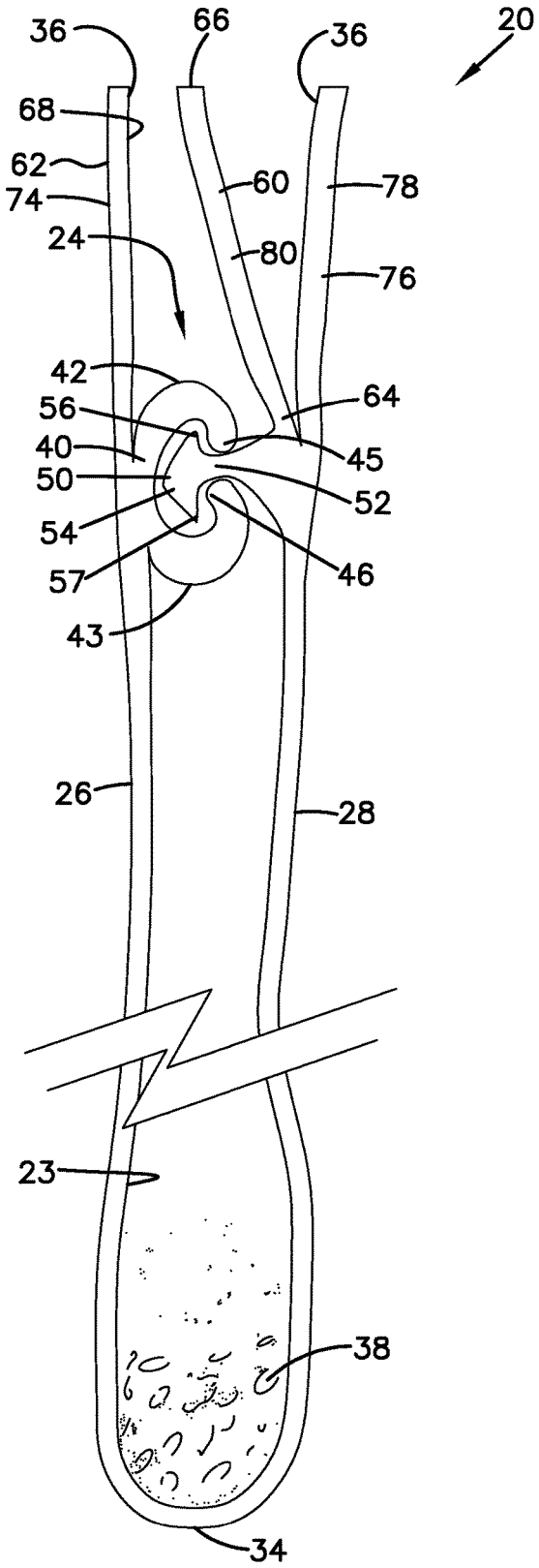
FIG. 2 is a schematic cross-sectional view of a portion of the reclosable pouch of FIG. 1 and showing the zipper closure, constructed in accordance with principles of this disclosure.

FIG. 1 illustrates a reclosable zipper pouch generally at 20. The pouch 20 will generally be flexible and can be made from a polymeric film, although other materials are usable. The pouch 20 includes a surrounding wall 22. The surrounding wall 22 encloses an interior volume 23 (FIG. 2). A reclosable zipper closure 24 is part of the pouch 20 to allow for selective closing and opening of the pouch 20 to either allow access to the interior volume 23 or block access to the interior volume 23.

The surrounding wall 22 includes first and second wall panels 26, 28 in opposition to each other. First and second sides 30, 32 join the first and second wall panels 26, 28. In some embodiments, the first and second sides 30, 32 can be seals connecting together the first and second wall panels 26, 28, while in other embodiments, the first and second sides 30, 32 are not seals, but merely form the sides 30, 32.

The pouch 20 includes a closed bottom 34. The closed bottom 34, in this embodiment, is between the first side 30 and second side 32 and at an opposite end of the pouch as the reclosable zipper closure 24. The closed bottom 34 can be part of the same single piece of material that forms the first wall panel 26 and second wall panel 28; alternatively, the closed bottom 34 can be a seal connecting together the first wall panel 26 and second wall panel 28.

The pouch 24 has an open mouth 36 at the end of the pouch 20 that is opposite from the closed bottom 34. The mouth 36 provides access to the interior volume 23, when the reclosable zipper closure 24 is in an unlocked position. When the reclosable zipper closure 24 is in a locked position, access to the interior volume 23 is blocked.

The reclosable zipper closure 24 in the pouch 20 is constructed to increase the difficulty for children to open the pouch 20 and gain access to the contents 38 of the interior volume 23, while still allowing easy opening for adults or senior citizens. Example embodiments are shown in FIGS.

2 (pouch 20) and 3 (pouch 20'). The same reference numerals will be used for analogous parts in these embodiments.

A first zipper profile member 40 is located on the first wall panel 26 and in a direction extending toward the second wall panel 28. Many different embodiments are possible. In the particular embodiment illustrated, the first profile member 40 is a female profile member having a pair of legs 42, 43 extending from the first wall panel 26 and ending at hooked free ends 45, 46. The legs 42, 43 are spaced sufficiently apart to receive and interlock or engage with a male profile member, to be discussed further below.

This embodiment illustrates the first zipper profile member 40 as the same extruded molded material as the first wall panel 26. It should be understood that in alternate embodiments, the first zipper profile member 40 can be part of a first zipper profile including a seal flange. The seal flange having the first zipper profile member 40 will then be secured, such as through heat, adhesive, and other known techniques, to the first wall panel 26.

The first zipper profile member 40 is adjacent to the mouth 36. In the embodiment shown, the first zipper profile member 40 is spaced from the mouth 36.

The zipper closure 24 further includes a second zipper profile member 50 on the second wall panel 28 and extending toward the first wall panel 26 and in a location to engage the first profile member 40.

Many embodiments are possible. In the particular embodiment shown, the second profile member 50 is a male member having a stem 52 extending from the second wall panel 28 and ending at an arrowhead 54. The arrowhead 54 includes a pair of arms 56, 57 extending therefrom. The arrowhead 54 is shaped to be received between the legs 42, 43 of the first profile member 40, and have the arms 56, 57 engage the hooked free ends 45, 46 of the legs 42, 43. In this manner, it should be appreciated that the first and second profile members 40, 50 are constructed and arranged to selectively interlock when pressed together and unlock when forced apart.

In the embodiment depicted, the second zipper profile member 50 is an extruded part of the second wall panel 28. In other embodiments, the second zipper profile member 50 can be part of a molded extrusion of a second zipper profile having a sealing flange. The sealing flange will then be attached to the second wall panel 28 through known techniques such as heat sealing, adhesive, etc.

The reclosable zipper pouch 20 includes a flange 60. The flange 60 will appear to be a mechanism for opening the pouch 20, when in reality, it will instead hide a flange that the consumer will actually need to pull open the zipper closure 24.

Many embodiments can be made. In the example embodiment illustrated, the flange 60 extends from the second wall panel 28 toward the first wall panel 26 in a way such that it is in covering relation to a portion 62 of the first wall panel 26 that extends between the first zipper profile member 40 and the mouth 36, when viewed from the open mouth 36. Of course, it should be understood that the flange 60 could extend from the first wall panel 26 toward the second wall panel 28 instead, and not affect the function of the flange 60.

In the example shown, the flange 60 extends from the second wall panel 28 at a position between the second profile member 50 and the mouth 36 and projects toward the first wall panel 26.

In the example shown, the flange 60 has a fixed end 64 at the second wall panel 28. The flange 60 could be secured to the second wall panel 28 through conventional techniques. The flange 60 could also be extruded as the same piece of material as the second wall panel 28. Further, the flange 60 could be extruded as part of a second zipper profile, which includes the second zipper profile member 50 and a seal flange for securing the second zipper profile to the second wall panel 28. In the embodiment shown, the fixed end 64 is shown adjacent to the second zipper profile member 50 and between the second zipper profile member 50 and the mouth 36.

The flange 60 further includes a free end 66. The free end 66 will be adjacent to the mouth 36 and at least adjacent to the first wall panel 26.

Figure 3:
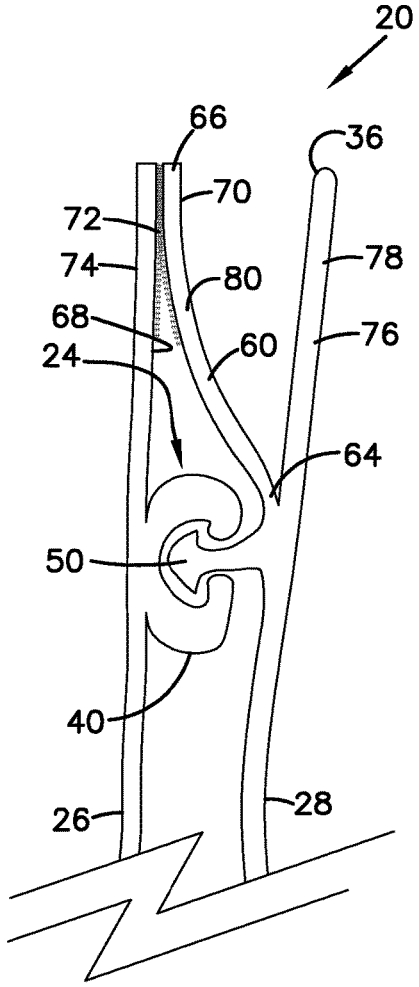
FIG. 3 is a schematic cross-sectional view of an alternate embodiment of the zipper closure depicted in FIG. 2.

In one example embodiment, and in reference now to FIG. 3, the free end 66 is releasably secured to the first wall panel 26. In the example shown, the free end 66 is releasably secured to an inside surface 68 of the first wall panel 26.

In FIG. 3, the flange 60 includes an attached section 70 extending from the free end 66 at least partially in a direction toward the fixed end 64.

The attached section 70 is releasably secured to the first wall panel 26 with a security mechanism 72. In one example, the security mechanism 72 can be pressure sensitive adhesive. In another example, security mechanism 72 can be a hook and loop fastener. Many other embodiments are possible for the security mechanism 72.

As can be seen in FIGS. 2 and 3, the flange 60 is angled relative to the first and second wall panels 26, 28. When a user looks at the pouch 20, particularly from the mouth 36, the flange 60 will conceal the presence of portion 62. Portion 62 functions as an opening flange 74 on the first wall panel 26. There is a portion 76, opposite of portion 62, which extends between the fixed end 64 of the flange 60 and the mouth 36. This portion 76 functions as an opening flange 78 for the second wall panel 28. Thus, when a consumer applies a pulling force at the mouth 36 to opening flange 74 and opening flange 78, this will transfer to a pulling force to the first and second zipper profile members 40, 50, separating them, to disengage the profile members 40, 50 and unlock the zipper closure 70, allowing access to the interior volume 23.

The flange 60 can operate as a decoy or false opening flange 80. This is because the flange 60 will cover the site of the opening flange 74 when viewed from the mouth 36. A child would not recognize this false flange 80 for what it is, and the child may try to open the zipper closure 24 by providing a pulling force to flange 60 and opening flange 78. This pulling force applied to flange 60 will not translate into a pulling force on the first zipper profile member 40, and thus, the zipper closure 24 will not open.

An adult consumer would be able to recognize the flange 60 was a false opening flange 80. An adult would be able to move the flange 60 in order to access the opening flange 74. In FIG. 3, the step of moving the flange 60 would include releasing the security mechanism 72 between the flange 60 and opening flange 74.

A method of making the reclosable zipper pouch 20 can include providing the surrounding wall 22 having closed bottom 34, first and second opposite sides 30, 32, open mouth 36, and first and second opposing wall panels 26, 28 between the first and second opposite sides 30, 32.

The method will include providing reclosable zipper closure 24 adjacent to the mouth 36. The zipper closure 24 can be pre-made and then secured to the wall panels 26. Alternatively, it can be extruded or made from the same piece of material as the wall panels 26, 28. The zipper closure includes first zipper profile member 40 on the first wall panel 26 and extending toward the second wall panel 28; second zipper profile member 50 on the second wall panel 28 and extending toward the first wall panel 26 and in a location to engage the first profile member 40. The first and second profile members 40, 50 are constructed and arranged to selectively interlock when pressed together and unlock when forced apart.

The method includes providing flange 60 extending from the second wall panel 28 toward the first wall panel 26. The flange 60 can be secured relative to the mouth 36 and reclosable zipper closure 24 such that it is in covering relation to portion 62 of the first wall panel 26 that is between the first zipper profile member 40 and the mouth 36, when viewed from the mouth 36.

The above description represents example principles of this disclosure. Many embodiments can be made applying these principles.

What is claimed is:

1. A recloseable zipper pouch comprising:

(a) a surrounding wall having a closed bottom, first and second opposite sides, and first and second opposing wall panels between the first and second opposite sides, and an open mouth defined by free ends of the first and second opposing wall panels; the surrounding wall defining an interior volume therein;

(b) a recloseable zipper closure below the mouth; the zipper closure providing selective access to the interior volume through the mouth; the zipper closure including:

(i) a first zipper profile member on the first wall panel and extending toward the second wall panel;

(ii) a second zipper profile member on the second wall panel and extending toward the first wall panel and in a location to engage the first profile member;

(iii) the first and second profile members being constructed and arranged to selectively interlock when pressed together and unlock when forced apart; and (c) a flange extending from the second wall panel toward the first wall panel and in covering relation to a portion of the first wall panel extending between the first zipper profile member and the mouth, when viewed from the open mouth;

(i) the flange having a fixed end at the second wall panel, adjacent to the second zipper profile, and a free end; the flange free end being adjacent to the mouth and at least adjacent to the first wall panel;

(ii) the flange being angled at a non-perpendicular angle relative to the second wall panel, as the flange extends from the fixed end to being flush with a terminal tip of the first wall panel.

2. A recloseable zipper pouch according to claim 1 wherein:

(a) the free end of the flange is releasably secured to the first wall panel.

3. A recloseable zipper pouch according to claim 2 wherein:

(a) the free end of the flange is releasably secured to an inside surface of the first wall panel.

4. A recloseable zipper pouch according to claim 2 wherein:

(a) the free end of the flange is releasably secured to the first wall panel with pressure sensitive adhesive.

5. A recloseable zipper pouch according to claim 2 wherein:

(a) the free end of the flange is releasably secured to the first wall panel with a hook and loop fastener.

6. A method of making a recloseable zipper pouch comprising:

(a) providing a surrounding wall having a closed bottom, first and second opposite sides, and first and second opposing wall panels between the first and second opposite sides, and an open mouth defined by free ends of the first and second opposing wall panels; the surrounding wall defining an interior volume therein;

(b) providing a recloseable zipper closure below the mouth; the zipper closure providing selective access to the interior volume through the mouth; the zipper closure including:

(i) a first zipper profile member on the first wall panel and extending toward the second wall panel;

(ii) a second zipper profile member on the second wall panel and extending toward the first wall panel and in a location to engage the first profile member;

(iii) the first and second profile members being constructed and arranged to selectively interlock when pressed together and unlock when forced apart; and (c) providing a flange extending from the second wall panel toward the first wall panel and in covering relation to a portion of the first wall panel extending between the first zipper profile member and the mouth, when viewed from the open mouth;

(i) the flange having a fixed end at the second wall panel, adjacent to the second zipper profile, and a free end; the flange free end being adjacent to the mouth and at least adjacent to the first wall panel;

(ii) the flange being angled at a non-perpendicular angle relative to the second wall panel, as the flange extends from the fixed end to a terminal tip of the first wall panel, and wherein the flange does not extend beyond the terminal tip of the first wall panel.

7. A recloseable zipper pouch according to claim 1 wherein:

(a) an entirety of the flange is angled at an acute angle relative to the second wall panel, as the flange extends from the fixed end to the terminal tip of the first wall panel.

8. A method according to claim 6 wherein:

(a) the step of providing a flange includes providing a flange in which an entirety of the flange is angled at an acute angle relative to the second wall panel, as the flange extends from the fixed end to the terminal tip of the first wall panel.

9. A method according to claim 6 further including a step of:

(a) releasably securing the free end of the flange to an inside surface of the first wall panel.

10. A method according to claim 9 wherein:

(a) the step of releasably securing the free end of the flange includes releasably securing the free end of the flange to the first wall panel with pressure sensitive adhesive.

11. A method according to claim 9 wherein:

(a) the step of releasably securing the free end of the flange includes releasably securing the free end of the flange to the first wall panel with a hook and loop fastener.

12. A recloseable zipper pouch according to claim 1 wherein:

(a) an entirety of the flange is angled at a non-perpendicular angle relative to the second wall panel.

13. A method according to claim 6 wherein:

(a) the step of providing a flange includes providing a flange in which an entirety of the flange is angled a non-perpendicular angle relative to the second wall panel.

14. A recloseable zipper pouch comprising:

(a) a surrounding wall having a closed bottom, first and second opposite sides, and first and second opposing wall panels between the first and second opposite sides, and an open mouth defined by free ends of the first and second opposing wall panels; the open mouth being at an end of the pouch opposite from the closed bottom; the surrounding wall defining an interior volume therein;

(b) a recloseable zipper closure below the mouth; the zipper closure providing selective access to the interior volume through the mouth; the zipper closure including:

(i) a first zipper profile member on the first wall panel and extending toward the second wall panel;

(ii) a second zipper profile member on the second wall panel and extending toward the first wall panel and in a location to engage the first profile member;

(iii) the first and second profile members being constructed and arranged to selectively interlock when pressed together and unlock when forced apart; and (c) a flange extending from the second wall panel toward the first wall panel and in covering relation to a portion of the first wall panel extending between the first zipper profile member and the mouth, when viewed from the open mouth;

(i) the flange having a fixed end at the second wall panel, adjacent to the second zipper profile, and a free end; the flange free end being adjacent to the mouth and at least adjacent to the first wall panel;

(ii) an entirety of the flange being angled at a non-perpendicular angle relative to the second wall panel, as the flange extends from the fixed end to being flush with the free end of the first wall panel in a direction toward the mouth and away from the bottom.

15. A recloseable zipper pouch according to claim 14 wherein:

(a) the free end of the flange is releasably secured to the first wall panel.

16. A recloseable zipper pouch according to claim 15 wherein:

(a) the free end of the flange is releasably secured to an inside surface of the first wall panel.

17. A recloseable zipper pouch according to claim 15 wherein:

(a) the free end of the flange is releasably secured to the first wall panel with pressure sensitive adhesive.

18. A recloseable zipper pouch according to claim 15 wherein:

(a) the free end of the flange is releasably secured to the first wall panel with a hook and loop fastener.

* * * * *